US012680405B2

(12) United States Patent
Eriksen et al.

(10) Patent No.: US 12,680,405 B2
(45) Date of Patent: Jul. 14, 2026

(54) PLUG BREAKER

(71) Applicant: TCO Group AS, Indre Arna (NO)

(72) Inventors: Tommy Eriksen, Voss (NO); Anja Berge Bauman, Kleppestø (NO); Richard Hagvåg Ringstad, Indre Arna (NO)

(73) Assignee: TCO Group AS, Indre Arna (NO)

( * ) Notice: Subject to any disclaimer, the term of this patent is extended or adjusted under 35 U.S.C. 154(b) by 0 days.

(21) Appl. No.: 19/187,374

(22) Filed: Apr. 23, 2025

(65) Prior Publication Data

US 2026/0168343 A1 Jun. 18, 2026

(30) Foreign Application Priority Data

Dec. 13, 2024 (NO) ..... 20241225

(51) Int. Cl.
*E21B 29/00* (2006.01)
*E21B 34/06* (2006.01)
*E21B 34/10* (2006.01)

(52) U.S. Cl.
CPC ..... *E21B 29/00* (2013.01); *E21B 34/063* (2013.01); *E21B 34/103* (2013.01)

(58) Field of Classification Search
CPC ..... E21B 29/00; E21B 34/063; E21B 34/103
See application file for complete search history.

(56) References Cited

U.S. PATENT DOCUMENTS

2014/0083716 A1* 3/2014 Frazier ..... E21B 34/10 166/376

* cited by examiner

*Primary Examiner* — Tara Schimpf
*Assistant Examiner* — Lamia Quaim
(74) *Attorney, Agent, or Firm* — Flener IP & Business Law

(57) ABSTRACT

A plug breaker system including: a plug breaker including a breaker body, a pressure catcher arranged on the breaker body, a release element, a breaker object; and a plug assembly including a plug, supported by a seat; and a breaker tubular including an upstream tubular portion and a downstream tubular portion, wherein the upstream tubular portion is located upstream of the plug and the downstream tubular portion is located downstream of the plug; wherein the plug assembly and the plug breaker are arranged in a housing within the breaker tubular; wherein the plug is downstream from the breaker body; wherein the plug breaker system is arranged to have a first position and a second position: in the first position, the release element is arranged such that the breaker body is stationary and the plug assembly is stationary with respect to the breaker tubular, and in the second position, the breaker body is arranged such that when the release element releases, the breaker body moves downhole, and the breaker object breaks the plug.

20 Claims, 10 Drawing Sheets

PLUG BREAKER

CROSS REFERENCES TO PREVIOUS APPLICATIONS

The present application claims priority to, Norwegian application number 20241225 filed Dec. 13, 2024; this is hereby incorporated by reference in its entirety.

FIELD OF INVENTION

The invention is in the field of systems to activate a downhole tool, exemplified by the breaking of a frangible plug. Specifically, the activation of a breaker that is only dependent on top pressure and breaks the frangible plug from the uphole side of the plug.

BACKGROUND

Many downhole tools can be activated by applying pressure. This can be easily done by pumping from above and is often preferable to more complicated activation means that require wirelines, ball drops, signals of various kinds like RFID or chemical activation. Many pressure activated systems require a counter that counts pressure cycles, but in its simplest form a single pressure spike, above what would normally occur in the well, can be enough for tool activation. In either case, it is of course important that the tool activates at the correct predetermined pressure.

Currently, plug systems are based on the principle that when the pressure applied to the plug from uphole is increased until a threshold pressure differential is experience across the plug, a shear element (e.g. shear pin, shear ring) breaks, the plug moves in an axial manner, and impacts a breaker object to break the plug.

The disadvantage of this is that although the pressure from topside can be controlled, i.e. increased by pumping, the pressure from below the plug is often hard to predict. For instance, as the reservoir is emptied the pressure from below usually decreases, and as new production lines are opened up the pressure may also vary. The deeper the well the less predictable the pressure from below often is. Ultimately, a very different pressure from below than what was calculated and the plug breaking system was designed for can lead to failure to open/break the plug.

If a frangible plug blocking a pipe is to be removed by driving a plug into a breaker object, this contact has to be fast enough (provide enough force) to break the plug. Otherwise, the plug will not break at the pressure it was designed to. The plug will simply rest upon the breaker object. In this case, the well operator will have to crank up the pressure, and subject the well to more pressure than was intended or desired, to drive the plug into the breaker object. This could have detrimental effects on the well or activate other tools to be activated at a higher pressure. For the mentioned frangible plug this slow breaking of the plug is what one could name a "soft open", rather than a normal opening where the plug is opened quickly as the released plug makes contact with the breaker object at considerable speed.

Frangible plugs are plugs that are brittle and are usually made of materials such as glass or ceramics. Unlike most materials, such materials are not corroded by the chemical well environment, nor do they change properties noteworthy with pressure and temperature. They are also very strong, so they can hold very high pressures without breaking outright. But due to their frangible nature, when subjected to point forces, such as can be provided by a knife edge or round surface (herein referred to as a breaker), they will shatter and break into small pieces and leave the pipe open. When the plug is frangible the resulting pieces will usually be small enough not to interrupt well operations, and if they are not a debris catcher can be used. Such frangible plugs are used for a variety of purposes where temporarily plugging of a well pipe (casing or liner) is desired, such as during completion or flotation.

For a simple frangible plug system, either the plug or breaker is able to move into the other but is prevented from doing so by something holding it in place; a tool release element. This something is typically a shear element such as a shear ring or shear pins that shear off when enough pressure is applied. If there is not sufficient pressure, or said pressure is increased too slowly, the shear element will shear but there might not be enough force for the breaker to impact the plug hard enough to break. This can also happen if the shear element is mistuned, or the tuning miscalculated, or if the well conditions are very different from what was expected, such as more viscous fluids or debris making it harder for parts to move, or if there is a surge of pressure from below the plug or a fluctuation in the pressure applied from above. It is possible that the pressure differential across the plug causes the plug or breaker to release but does not have sufficient force to break the plug. Regardless of the specific reasons for the "soft opening", the results are that the frangible plug and breaker are slowly brought in contact and then just rest in contact, no breaking occurs. Then it has become much harder to break the plug, as it or the breaker now cannot build up speed and slam into one another as there is no moving distance to build up said speed over. Therefore, more pressure than was intended or desired must then be applied to break and open the plug, or it may not be possible to apply enough energy to break the plug.

These are inherent problems with a system that depends on differential pressure to move the plug. However, a system that is based on only uphole pressure does not suffer these issues. The simplest form of such a system is to hold the plug stationary and move the breaker instead. Several examples of such a system that breaks the plug from the uphole side (top side) due to uphole pressure are disclosed.

SHORT SUMMARY OF THE INVENTION

In one general aspect, plug breaker system may include a plug breaker having a breaker body, a pressure catcher arranged on the breaker body, a release element, a breaker object. Plug breaker system may also include a plug assembly having a plug, supported by a seat. System may furthermore include a breaker tubular having an upstream tubular portion and a downstream tubular portion, where the upstream tubular portion is located upstream of the plug and the downstream tubular portion is located downstream of the plug. System may in addition include where the plug assembly and the plug breaker are arranged in a housing within the breaker tubular. System may moreover include where the plug is downstream from the breaker body. System may also include where the plug breaker system is arranged to have a first position and a second position. System may furthermore include in the first position, the release element is arranged to keep the breaker body from moving, and the plug assembly is stationary with respect to the breaker tubular. System may in addition include in the second position, the breaker body is arranged such that when the release element releases, the breaker body moves downhole, and the breaker object impacts and breaks the plug.

Implementations may include one or more of the following features. Plug breaker system where the plug is stationary in the second position. Plug breaker system where the breaker body and the breaker object are a single element. Plug breaker system where the breaker body is not in direct contact with the breaker object in the first position. Plug breaker system where the pressure catcher is arranged on an uphole and distal portion of the breaker body. Plug breaker system where the pressure catcher radially protrudes from the breaker body. Plug breaker system where the release element is an explosive, valve, or a counter. Plug breaker system where the release element is a shear element or a tensile element. Plug breaker system where the release element is arranged in a through hole in the breaker tubular. Plug breaker system where the plug breaker further may include a channel and a channel block; where the channel block has an open and closed position, the channel block arranged such that: there is no fluid communication between the uphole well pressure and the channel block in the closed position; there is fluid communication between the uphole well pressure and the channel block in the open position; and the release element arranged to release when the channel block is in the open position. Plug breaker system where the channel is arranged in the breaker body. Plug breaker system may include a breaker chamber arranged such that at least a portion of the breaker body enters the breaker chamber in the second position. Plug breaker system may include a sealed breaker chamber, where the sealed breaker chamber is in contact with the release element, and where the release element is a shear element. Plug breaker system where the breaker chamber is arranged between the breaker body and the housing. Plug breaker system where the breaker body further may include an upstream chamber sealing element (16B) and a downstream chamber sealing element (16A). Plug breaker system where the plug breaker further may include a breaker pocket, where the breaker object is arranged at least partially within the breaker pocket in the second position. Plug breaker system where the seat is a portion of the breaker tubular. Plug breaker system may include a holder, where the plug assembly is arranged in the holder, and where the holder is stationary in the first position with respect to the breaker tubular. Plug breaker system where the plug is may include of two or more layers. Plug breaker system where the plug assembly further may include a downstream bearing ring or an upstream bearing ring, arranged between the plug and the seat. Plug breaker system where the bearing ring is sealing the plug. Plug breaker system where there is no sealing between the plug and the housing. Plug breaker system where the breaker object rests directly on the plug in the first position. Plug breaker system where the release element is upstream of the plug.

In one general aspect, plug breaker system may include a plug breaker having a breaker body, a pressure catcher arranged on the breaker body, a breaker object. Plug breaker system may also include a plug assembly having a plug, supported by a seat. System may furthermore include a breaker tubular having an upstream tubular portion and a downstream tubular portion, where the upstream tubular portion is located upstream of the plug and the downstream tubular portion is located downstream of the plug; where the plug assembly and the plug breaker are arranged in a housing within the breaker tubular; where the plug is downstream from the breaker body; where the plug breaker system is arranged to have a first position and a second position: in the first position, the plug assembly is stationary with respect to the breaker tubular, the plug is intact; and in the second position, the breaker object is arranged such that it breaks the plug. System may in addition include where the breaker body is in direct contact with the breaker object and the breaker object is in direct contact with the plug.

BRIEF DESCRIPTION OF THE FIGURES

The above and further features of the invention are set forth with particularity in the appended claims and advantages thereof will become clearer from consideration of the following detailed description.

Embodiments of the present invention will now be described, by way of example only, with reference to the following diagrams wherein.

REFERENCE NUMBERS AND CORRESPONDING ELEMENTS

10 Plug Breaker
11 Breaker Body
12 Pressure Catcher
13 Release Element
131 Shear Element Lip
132 Shear Element Body
14 Breaker Chamber
15 Breaker Object
16A Downstream Chamber Sealing Element
16B Upstream Chamber Sealing Element
17 Breaker Pocket
18 Channel
19 Channel Block
20 Breaker Tubular
21 Upstream Tubular Portion
22 Downstream Tubular Portion
23 Housing
30 Plug Assembly
31 Plug
32 Seat
33A Downstream Bearing Ring
33B Upstream Bearing Ring
34 Plug Sealing Element
40 Plug Assembly Holder
100 Plug Breaker System

DETAILED DESCRIPTION OF THE INVENTION

Reference will now be made in detail to the present embodiments of the invention, examples of which are illustrated in the accompanying drawings. Alternative embodiments will also be presented. The drawings are intended to be read in conjunction with both the summary, the detailed description, and any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art.

In this plug breaker system, the plug is broken from upstream of the plug. The plug is stationary within the housing of the tubular. When the pressure reaches a desired threshold, the release mechanism releases a portion of the plug breaker (usually the breaker body), while the plug remains stationary. The breaker body will force the breaker object into the plug, breaking the plug.

Direction terms such as up, down, left, right, above, below, etc. are being used in reference to the orientation of the elements in the figures. In no way is this intended as limiting.

Figure 1:
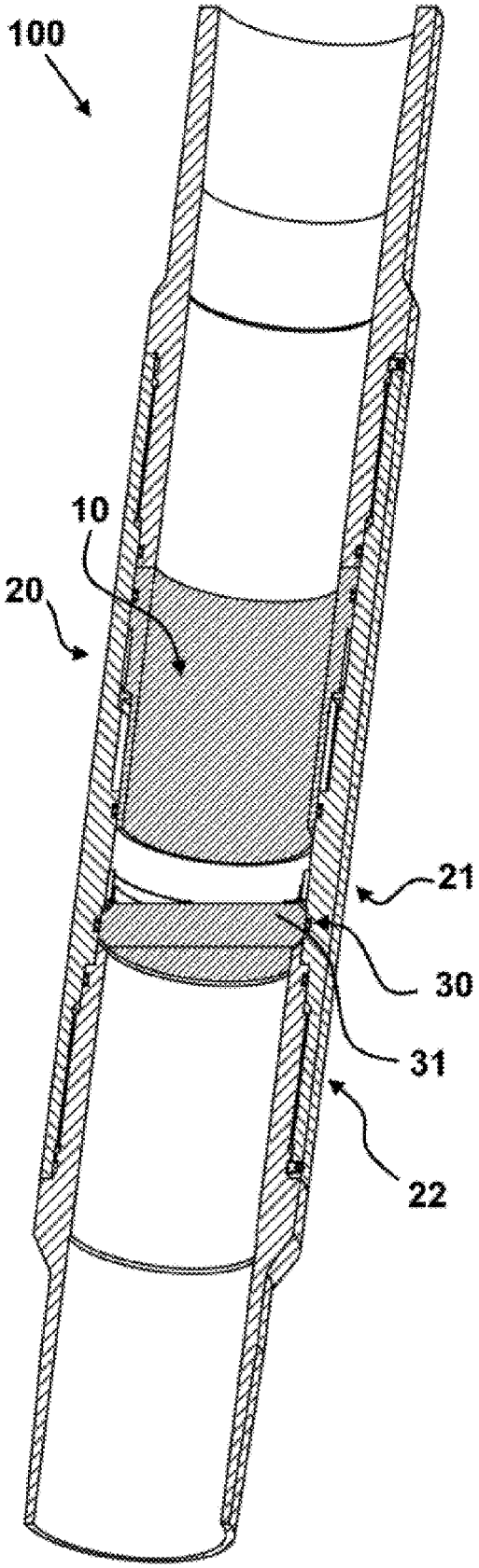
FIG. 1 discloses a perspective view of an example of a plug breaker

Reference is made to FIG. 1. FIG. 1 discloses a perspective view of an example of a plug breaker system 100 in the starting position. The plug breaker system 100 comprises a plug breaker 10, a breaker tubular 20, and a plug assembly 30. The plug assembly 30 comprises a plug 31. The breaker tubular 20 comprises an upstream tubular portion 21 where the breaker tubular 20 is at least partially upstream of the plug 31, and a downstream tubular portion 22 where the breaker tubular 20 is at least partially downstream of the plug 31. In this starting position, the fluid flow through breaker tubular 20 is fully or partially prevented by the plug 31. In operation, pressure from upstream pushes on the plug breaker 10 and causes it to move downstream axially. The plug breaker 10 will impact the plug 31 and break it, restoring fluid flow through breaker tubular 20.

Figure 2:
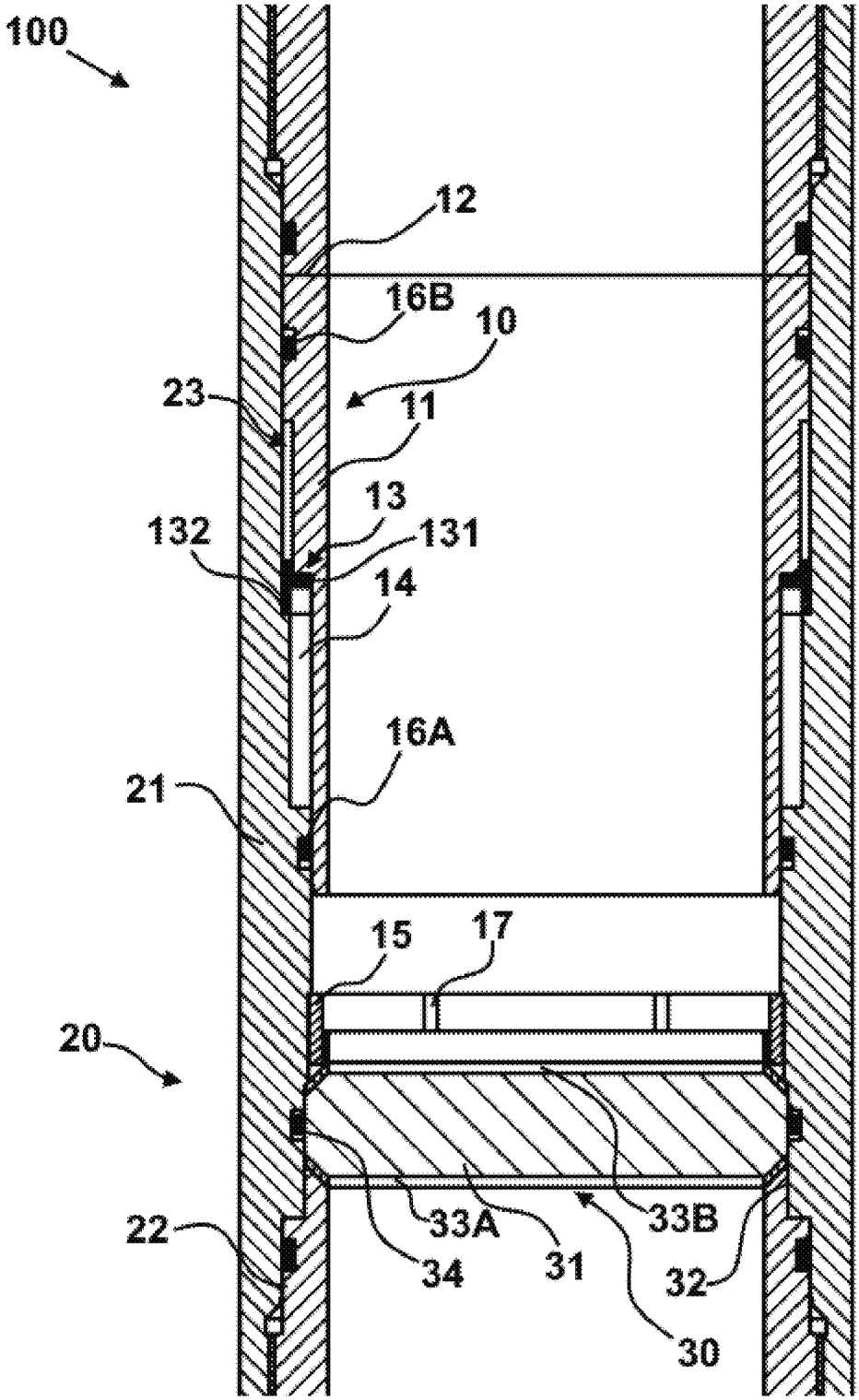
FIG. 2 discloses a cross-sectional side view of the starting position of a plug breaker FIG. 3A-3D discloses a cross-sectional side view of the positions of the plug breaker in operation FIG. 4 discloses a cross-sectional side view of an another example of a plug breaker FIG. 5A-5C disclose a cross-sectional side view of an examples of a multicycle plug breaker system FIG. 6A and FIG. 6B disclose a cross-sectional side view of another example of a plug breaker system FIG. 7 discloses a cross-sectional side view of another example of a plug breaker with an explosive release mechanism.

Reference is made to FIG. 2. FIG. 2 discloses a cross-sectional side view of the starting position of the plug breaker system 100 of FIG. 1. The plug breaker system 100 comprises a first position and a second position. In the first position the plug breaker 10 and the breaker tubular 20 are stationary and the breaker object 15 is not in contact with the plug 31. The fluid flow is impeded—usually little or no fluid flow possible but it doesn't have to be fluid tight. In the second position the breaker object 15 makes contact with the plug 31, the plug 31 is broken, and fluid flow is restored through the plug breaker system 100.

The plug breaker system 100 of FIG. 2 comprises a plug breaker 10, a breaker tubular 20, and a plug assembly 30. The plug breaker 10 comprises a breaker body 11, a pressure catcher 12 arranged on the breaker body 11, a release element 13, a breaker chamber 14, and a breaker object 15 arranged at least partially in a breaker pocket 17. The breaker object 15 is arranged such that it starts to break the plug 31 on contact.

The pressure catcher 12 is the portion of the plug breaker 10 that the pressure from uphole acts upon to cause the release element 13 to release. In most of the figures, it is the topmost portion of the breaker body 11. The breaker body 11 is the portion of the plug breaker 10 that moves in the second position to cause the plug 31 to break. Normally this will be by making contact with the breaker object 15 to drive the breaker object 15 into the plug 31. Also note, that the uphole pressure also acts upon the plugs 31 as well.

The release element 13 is the element or elements that prevent the breaker body 11 from moving from the first position to the second position. When the release element 13 releases, the breaker body 11 is free to move downwards. In this specific case, the release element 13 is a shear ring. The shear ring has two portions, a shear ring lip 131 and shear ring body 132. In this case, the breaker body 11 is supported by the shear ring lip 131. When the uphole pressure is high enough, the shear ring separates into at least two pieces, shear ring lip 131 and shear ring body 132. The shear ring lip 131 moves when the plug breaker 10 transitions from the first position to the second position, and the shear ring body 132 does not move between the first and second positions.

Reference is made to FIG. 2. In the disclosed FIG. 2, the breaker chamber 14 is formed between the breaker body 11 and the housing 23. The breaker chamber 14 shown is sealed by the downstream chamber sealing element 16A and upstream chamber sealing element 16B that isolate the breaker chamber 14. The breaker chamber 14 is dimensioned such that the breaker body 11 can move downhole. This can be particularly advantageous if a shear element is being used for the release element 13. The release element 13 will be discussed in detail shortly.

The plug assembly 30 comprises a plug 31, a seat 32, a downstream bearing ring 33A, an upstream bearing ring 33B, and a plug sealing element 34. The plug 31 is supported by the seat 32. A bearing ring (33A,33B) is arranged between the plug 31 and the seat 32. A plug sealing element 34 prevents fluid from flowing around the plug 31. The purpose of the bearing ring(s) 33A,33B is to prevent the glass from breaking due to contact with a hard metal surface.

The breaker tubular 20 comprises an upstream tubular portion 21 and a downstream tubular portion 22. The upstream tubular portion 21 is the portion of the breaker tubular 20 that is on the upstream side of the plug 31. The downstream tubular portion is the portion of the breaker tubular 20 that is downstream of the plug 31. The breaker tubular 20 can be made of more than one tubular. For example FIG. 3A-3D discloses a breaker tubular 20 with two separate tubulars. The housing 23 is the portion of the tubular 20 that is made to accommodate the plug breaker 10, plug assembly 30, and any components needed, directly or indirectly.

There are several types of release elements 13 that are mechanical elements. Examples include tensile elements (elements that break when enough force stretches them apart), crumple elements (elements that crumple when enough force is applied), and shear elements (transverse force causes these elements to break). Each of these elements cause a mechanical release. These kinds of release elements 13 release by a physical deformation: the crumple ring compresses, the tensile element breaks in two, the shear element breaks. By a shear release element, it is meant a release element 13 that breaks into two or more pieces due to the application of a shear force. Common examples of shear elements include shear rings, shear screws, and shear pins. All of these break into at least one portion that remains stationary with respect to the housing in the second position (shear ring body 132) and at least one portion that moves with respect to the housing in the second position (shear ring lip 131). It is possible to install the shear elements through the outside wall of the breaker tubular 20.

It is possible to use friction to hold the breaker body in place. When the pressure on the pressure catcher 12 is high enough, the force overcomes that of the force of friction, and the plug breaker 10 activates.

In the figures, the pressure catcher 12 is shown as the uppermost portion of the breaker body 11, however this is not a requirement. There may be situations where it is desirable to have a pressure catcher 12 with a larger area. As the force on the pressure catcher is the uphole pressure multiplied by the area, adjusting the area will adjust the force on the breaker body 11. It may not be desirable to simply make the entire breaker body 11 larger, rather a radial protrusion on the breaker body 11 will increase the area without increasing its overall thickness.

In the figures, the breaker body 11 is a sleeve. It is also possible to have a breaker body 11 that is a portion of a sleeve, an item that does not have an annular shape, or one that does not extend around the inside of the breaker tubular 20.

The breaker chamber 14 is shown as sealed by downstream chamber sealing element 16A and upstream chamber sealing element 16B between the housing 23 and the breaker body 11. This is not the only way to have a sealed chamber. For example, the chamber could be sealed separately from the breaker body 11. Additionally, the breaker chamber 14 is not required at all. This would be adjusted depending on the type of release element 13 that was being used. In this way, it is not a requirement that the end of the breaker body 11 toward plug 31 is in contact with inside of the breaker tubular 20 (forming a chamber).

The examples presented in the figures include a breaker object 15 that is at least partially located in a breaker pocket 17. This is not essential. For example, if the breaker body 11 was itself, or had integrated into it, the breaker object 15, the breaker pocket 17 would not be needed.

This kind of plug breaker 10 could be used on several plugs 31 stacked on top of each other or several layers of material (usually glass or ceramic). Also note that it would be possible to use such a plug breaker 10 on several plugs 31 that are not in contact with each other. The breaker object 15 could be driven into multiple separate plugs 31 simply by modifying the length of the breaker body 11 or breaker object 15.

While a stationary plug 31 is preferred, it is possible for plug 31 to be in motion when the plug breaker 10 is released to travel from the first starting position to the second position. In that case the speed that the breaker object 15 travels at would have to exceed that of the plug 31.

The bearing rings are not essential. This will depend upon if the plug 31 itself can take the metal contact without breaking.

The plug sealing element 34 is not necessary. There are many applications, e.g. flotation, where a fluid tight seal is not needed. If sealing is desired, it can also be done by the downstream bearing ring 33A and/or the upstream bearing ring 33B. Both a plug sealing element 34 and a sealing bearing ring can be used.

The seat 32 of the figures is part of the breaker tubular 20. Specifically, it can be where two tubulars (that make up the overall breaker tubular 20) meet. This makes installation easier. However, it is also possible that this is a simple protrusion from the breaker tubular 20. Additionally, it is also possible that the plug assembly 30 or plug 31 is in a plug assembly holder 40 that is attached to the housing 23, and rests on the breaker tubular 20.

It is possible that another component, rather than pressure in the upstream tubular portion 21, causes the shear element to be broken. For example, the entire breaker body 11 can be mechanically forced downhole until the shear element breaks.

While the figures show a configuration where the breaker object 15 is downhole from the breaker body 11. This is not a requirement. It is possible for the breaker object 15 to be arranged at the top of the breaker body 11 (or even being a portion of the breaker body 11).

It can be advantageous to prevent the breaker body 11 from moving uphole after it has entered the second position. This can be accomplished by having the breaker body lock 11 in place. For example, having a element (often a snap ring) that expands into a groove to prevent further movement of the breaker body 11.

Figures 3A, 3B:
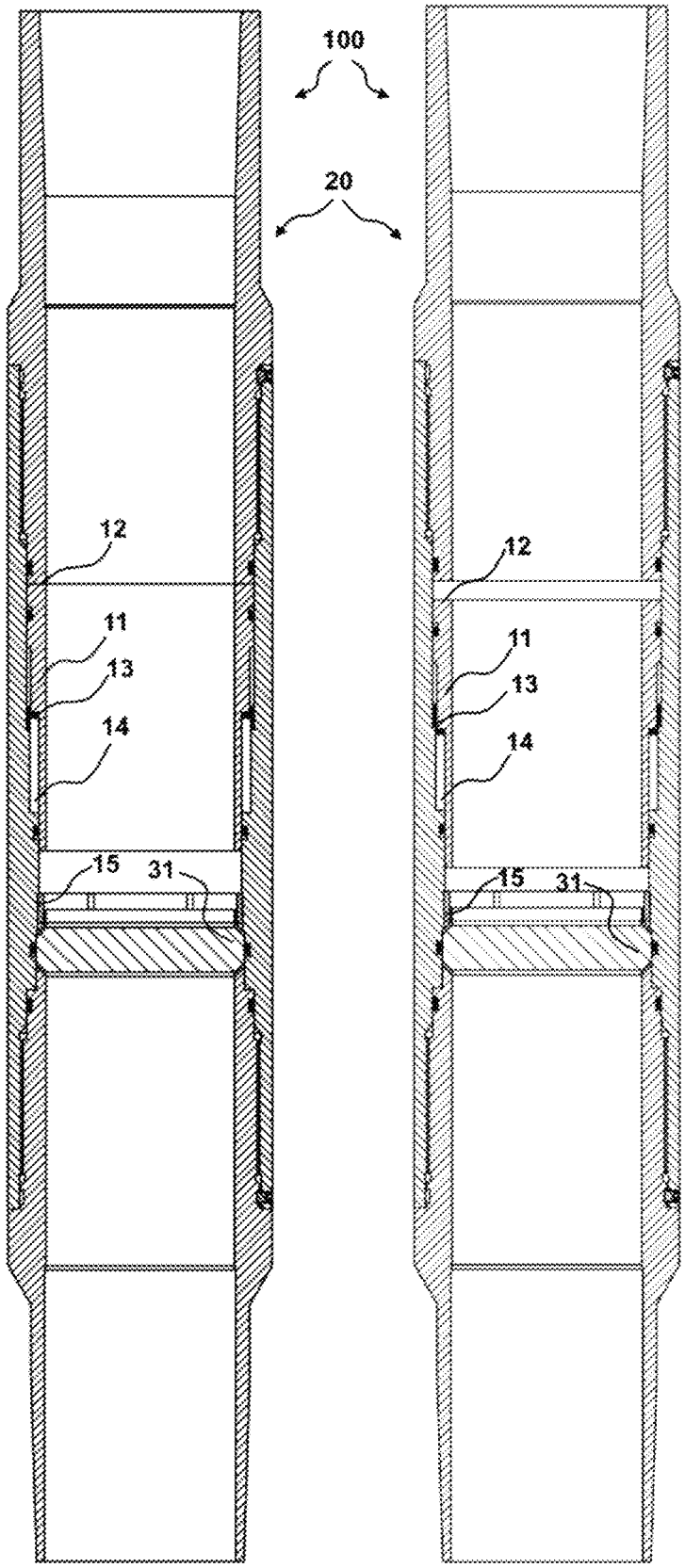

Reference is made to FIGS. 3A-3D. FIG. 3A-3D discloses a cross-sectional side view of the positions of the plug breaker system 100 in operation. Reference is made to FIG. 3A that shows the first position of the plug breaker system. Both the breaker body 11 and the plug 31 are stationary. The breaker body 11 is stationary because the release element 13 has not released it yet. Pressure is applied to the pressure catcher 12.

Reference is made to FIG. 3B that discloses an intermediate phase between position 1 and position 2. When sufficient pressure has been applied, the release element 13 releases the breaker body 11.

The breaker body 11 is then free to move toward the plug 31. A portion of the breaker body 11 enters into the breaker chamber 14.

Figures 3C, 3D:
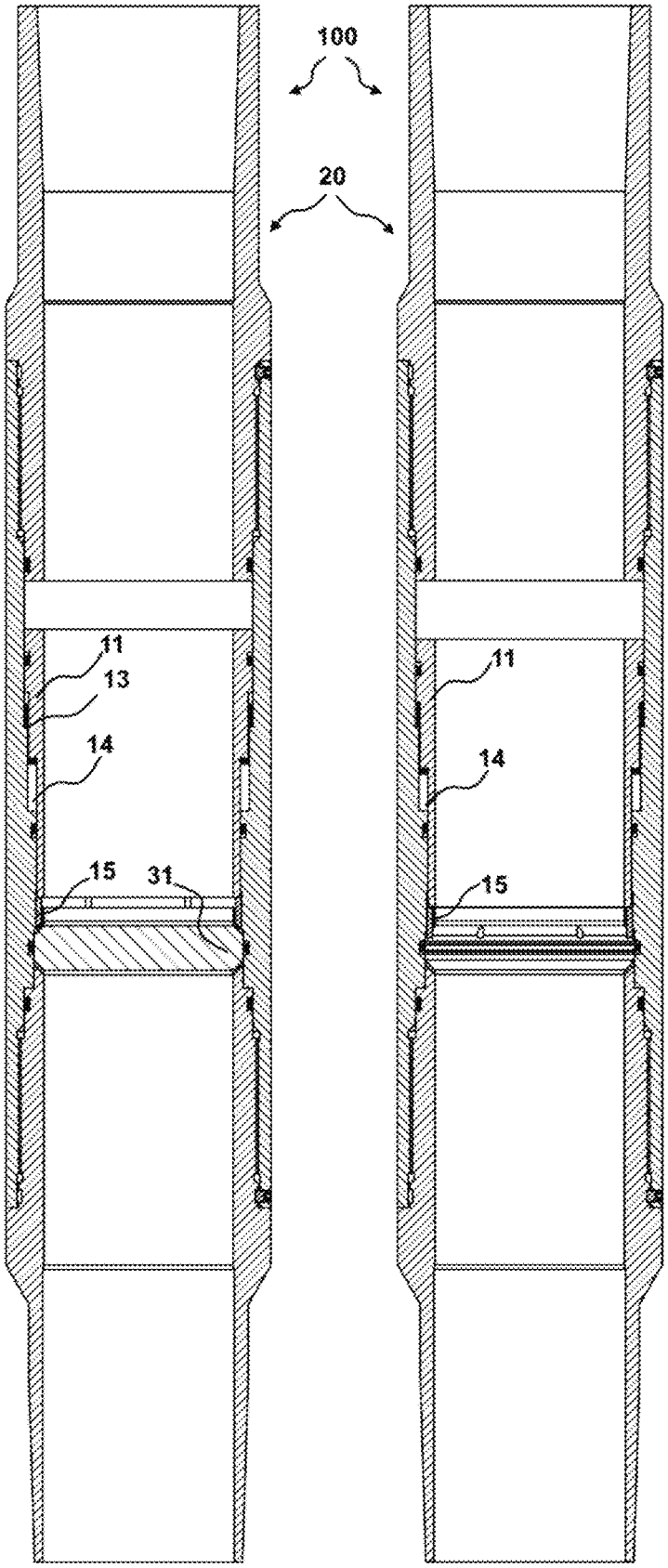

Reference is made to FIG. 3C that discloses the second position. The breaker body 11 has made contact with the breaker object 15 and has been pushed into the plug 31.

Reference is made to FIG. 3D that discloses the plug breaker system 100 after the plug 31 has been broken and fluid can flow through the breaker tubular 20 again.

Figure 4:
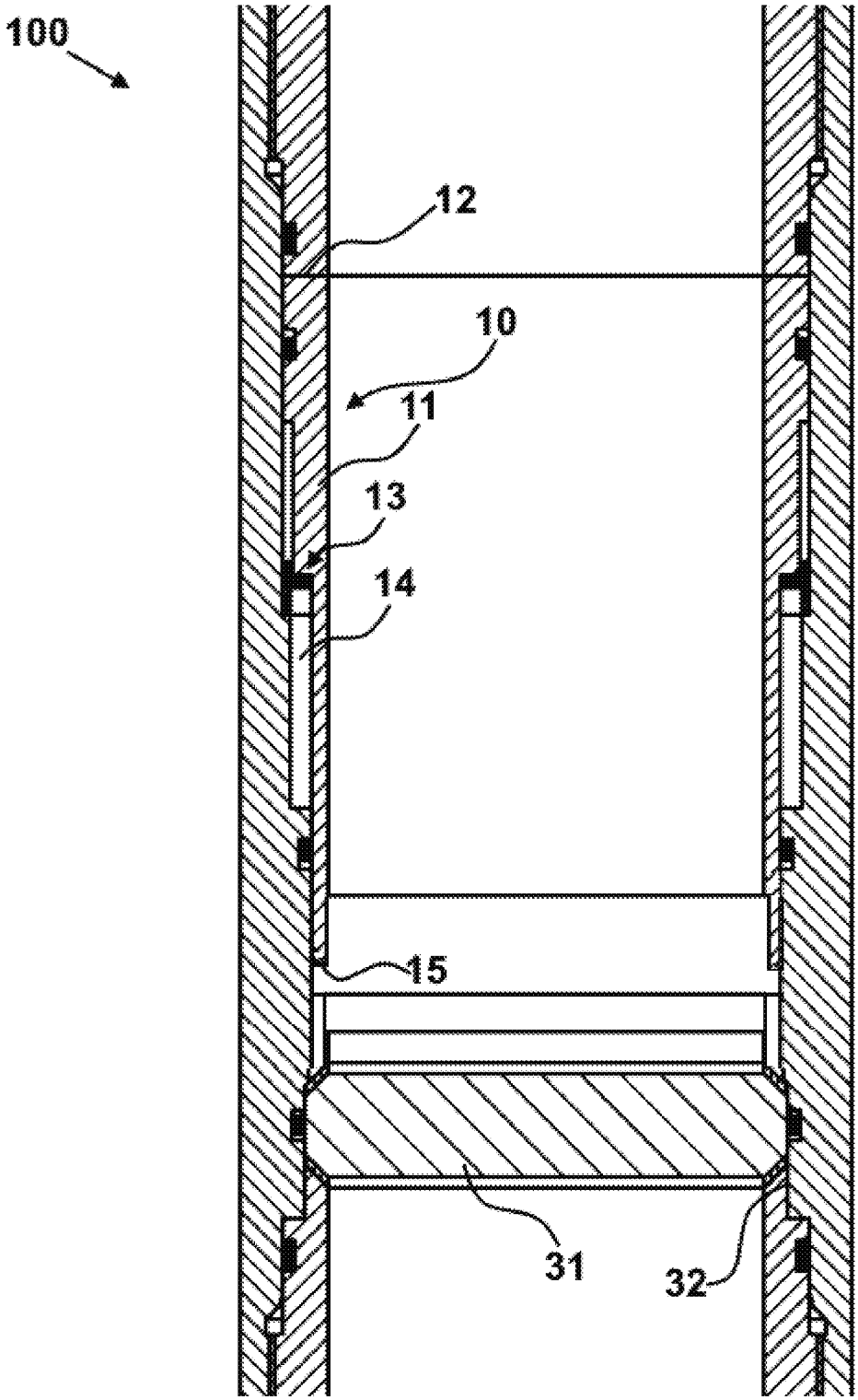

Reference is made to FIG. 4. FIG. 4 discloses a cross-sectional side view of another example of a plug breaker. In this example, as compared to FIGS. 1-3D, there is no separate breaker object 15. As before, the plug breaker 10 comprises an entire breaker body 11, a pressure catcher 12, and a release element 13. The operational principles are the same, when the pressure is high enough on the pressure catcher 12, the release element 13 releases and allows at least a portion of the plug breaker 10 to move (this is often the entire breaker body 11). The end of the breaker body 11 is considered the separate breaker object 15 as that is what impacts the stationary plug 31 (supported by the seat 32).

Another example is to have the breaker body 11 is in direct contact with the plug 31. As mentioned above, in this case the breaker object 15 is the downstream end of the breaker body 11. Another example is to arrange the plug breaker 10 such that the breaker body 11 is in direct contact with the breaker object 15 and the breaker object 15 is in directly with the plug 31. In such a configuration, the uphole pressure would simply be forced into the plug 31. When the contact force exceeded the amount needed to break the plug 31, it breaks. This contact force will be less than the force needed to rupture the plug 31 purely by uphole pressure. In the second position of this embodiment, the breaker object has been forced into the plug 31, causing it to break.

Figure 5A:
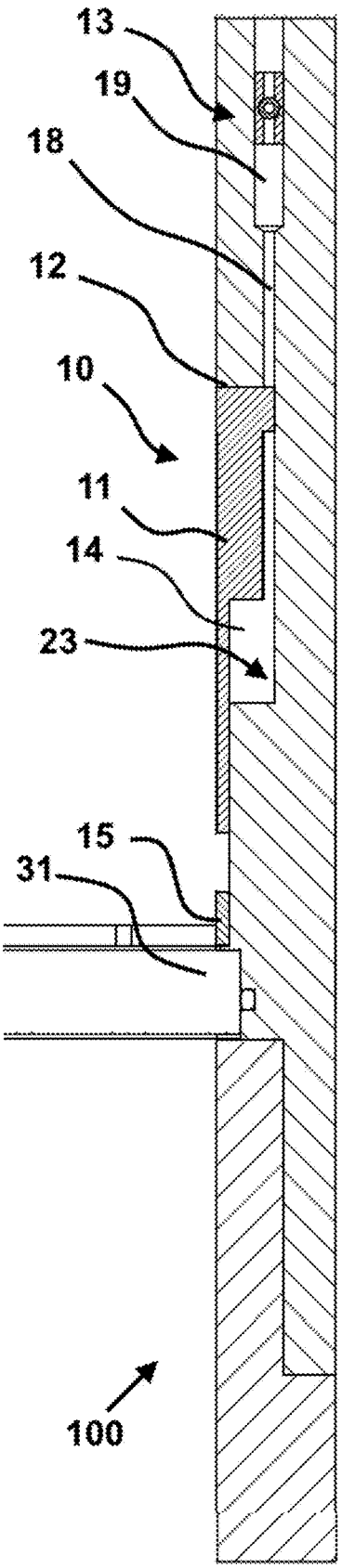
Figure 5B:
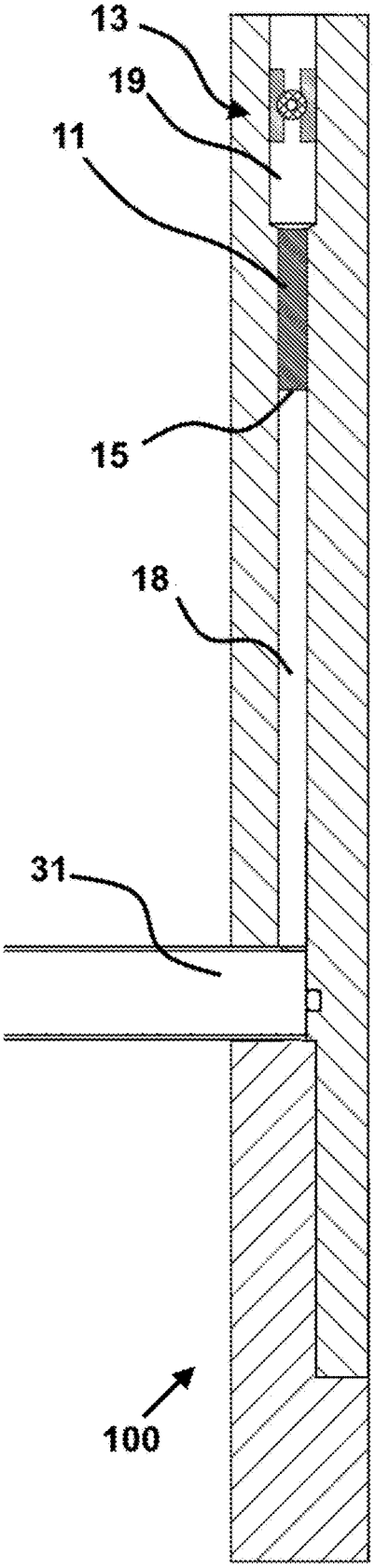
Figure 5C:
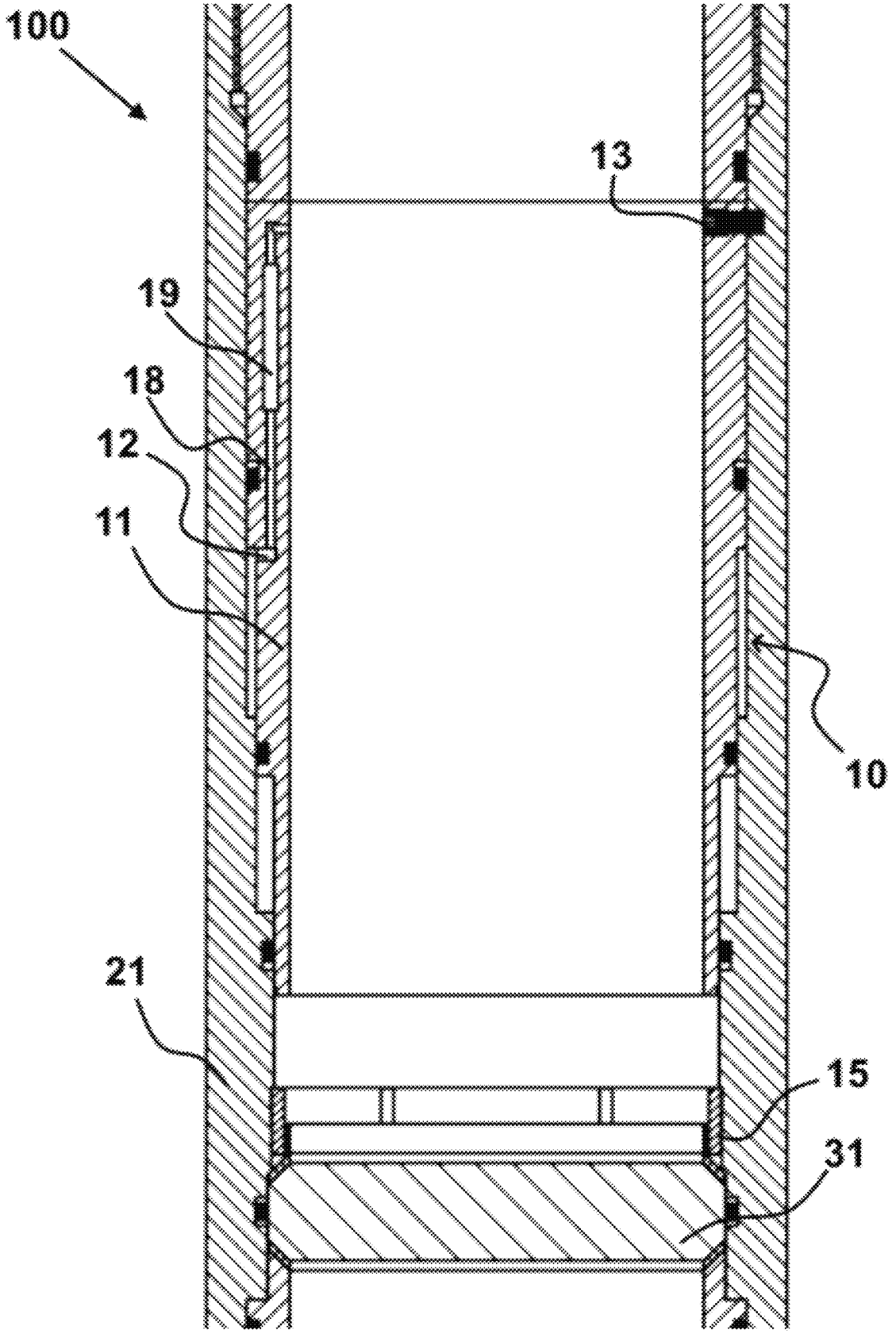

Reference is made to FIGS. 5A-5C. FIG. 5A-5C disclose an cross-sectional side view of examples of a multicycle plug breaker system 100. Note that these examples operate by the same principles as described previously. The channel 18 of FIGS. 5A and 5B are arranged in the breaker tubular 20. The channel 18 of FIG. 5C is arranged in the breaker body 11.

By multicycle it is meant the well pressure can be increased and decreased multiple times, exceeding the pressure that they would normally activate the release mechanism 13, without the plug breaker 10 activating and breaking the plugs 31. For these figures, the plug breaker 10 comprises a release element 13. channel 18, and a channel block 19. The channel block 19 separates the fluid pressure in the upstream tubular portion 21 from the channel 18. Note a multicycle plug can be operated in as a single cycle plug if desired.

In these examples, the channel 18 is within the breaker body 11 itself. The channel 18 can be arranged in the breaker tubular 20 itself or in a sealed gap between the breaker tubular 20 and another element. It can also be arranged such that it is in the plug breaker 10, but not in the breaker body 11 itself.

The most common examples of channel block 19 are burst disks and valves. Burst disks (or rupture disks) will break when the uphole fluid pressure exceeds a threshold value. In the first position the channel block 19 is closed. When the fluid pressure is considered high enough to make the breaker body 11 move with sufficient force to break the plug 31, the channel block 19 is opened. The uphole fluid pressure from enters the channel 18 and acts upon the pressure catcher 12. This releases the breaker body 11 so it can lead to breaking the plug. The opening of the channel block 19 can be attained using mechanical counters, pressure pulses patterns, or electronic triggers. In the specific example shown, the fluid pressure in the channel moves it. Another possibility is that the opening of the channel block 19 causes the fluid pressure to act upon another element that results in the breaker body 11 moving. Preferably the channel 18 is sealed in order to insure that there is a pressure differential between the channel 18 and the pressure in the upstream tubular portion 21. When the channel block 19 is opened, there will be a high pressure on the uphole side of the pressure catcher 12 than the downhole side of the pressure catcher.

Reference is made to FIG. 5A. FIG. 5A discloses that the pressure catcher 12 is a portion of the plug breaker 10 that is arranged in the channel 18. When the channel block 19 is closed, the pressure above and below the pressure catcher 12 in the channel 18 is the same. The breaker body 11 will move toward the plug 31. This will make contact with the separate breaker object 15 and drive the breaker object 15 into the plug 31. In this example, the release mechanism 13 is the combination of the channel 18 and channel block 19.

In the simplest example of this kind of release element 13, the pressure catcher 12 is in the channel 18 and a portion of the breaker body 11. This is not required. It would also be possible to have an element that connects the breaker body 11 to the pressure catcher 12 (at least a portion of which is within the channel 18) such that the breaker body 11 will move when the release element 13 releases. The simplest of this would be an element that connects the breaker body 11 and the pressure catcher 12 such that they move together.

It would be possible to use a mechanical type release mechanism 13, in addition to the combination of channel 18 and channel block 19, to secure the breaker body 11 to the housing 23. This can be desirable if there is concern that the breaker body 11 will move before it is desired to break the plug 31. It is also possible that the breaker chamber 14 is sealed, as in FIG. 2, with a downstream chamber sealing element 16A and/or a upstream chamber sealing element 16B (not shown).

Reference is made to FIG. 5B. FIG. 5B discloses an example of the plug breaker 10 where the breaker body 11 is entirely arranged within the channel 18. As in FIG. 5A, the release of the channel block 19 causes the fluid pressure from the breaker tubular 20 to enter the channel 18. The channel 18 is at a lower pressure than the breaker tubular 20. That drives the breaker body 11 downhole away from the higher pressure, and into the plug 31 directly. In this example the breaker object 15 is part of the breaker body 11. Note that the release mechanism 13 is, as in FIG. 5A, a combination of the channel 18 and the channel block 19. Like in FIG. 5A, the breaker body 11 can be held in place with an additionally release mechanism 13.

Reference is made to FIG. 5C. FIG. 5C discloses another example of a plug breaker system 100. It discloses a plug breaker 10 with a channel 18 and channel block 19. Unlike FIGS. 5A and 5B, the release mechanism 13 is not the combination of channel 18 and channel block 19. In this example, the release mechanism 13 is a shear element (particularly, a shear pin). Until the channel block 19 opens the channel 18 to uphole well pressure, there is no pressure differential across the release mechanism 13. The pressure catcher 12 is the portion of the breaker body 11 that is in contact with the channel 18. Once the channel block 19 opens, there will be a pressure differential across the release mechanism 13. This will cause the shear element to release (break), and drive the breaker body 11 downwards, contacting the breaker object 15, and into the plug 31 (and breaking it). Note that the shear element would break the first time the pressure differential was large enough (single cycle). In this example, the shear element doesn't have any pressure differential across it, until the channel block 19 opens.

Note that it is not required that the release mechanism 13 releases simultaneously when the channel block 19 opens. It is preferable however. Also note, that it is possible to replace the shear element with another type of mechanical release element, as discussed previously.

The combination of channel 18 and channel block 19 can be used will all of the examples of the plug breaker system 100 that are shown in FIGS. 1-4.

Figure 6A:
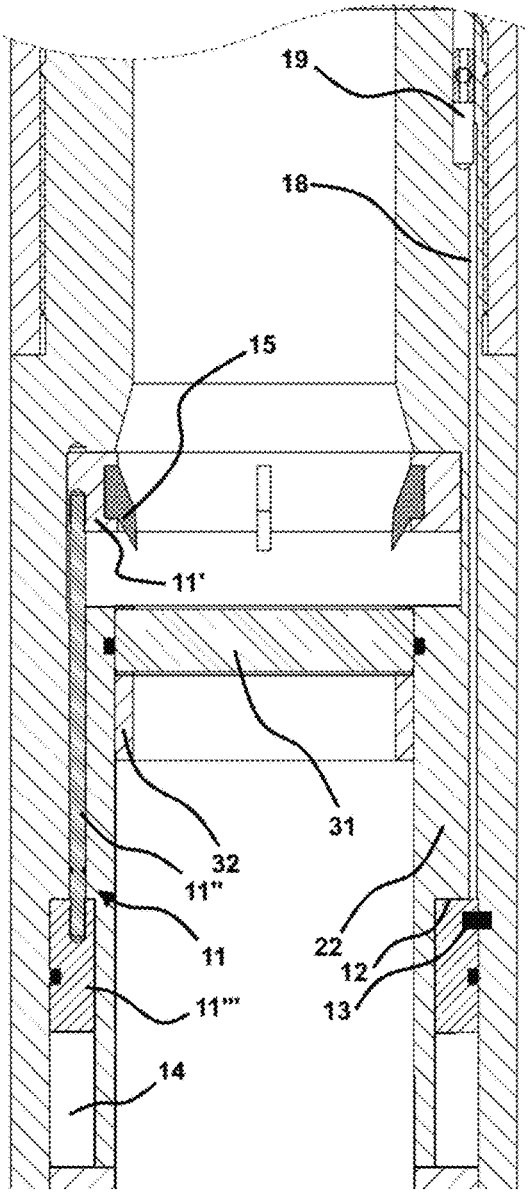
Figure 6B:
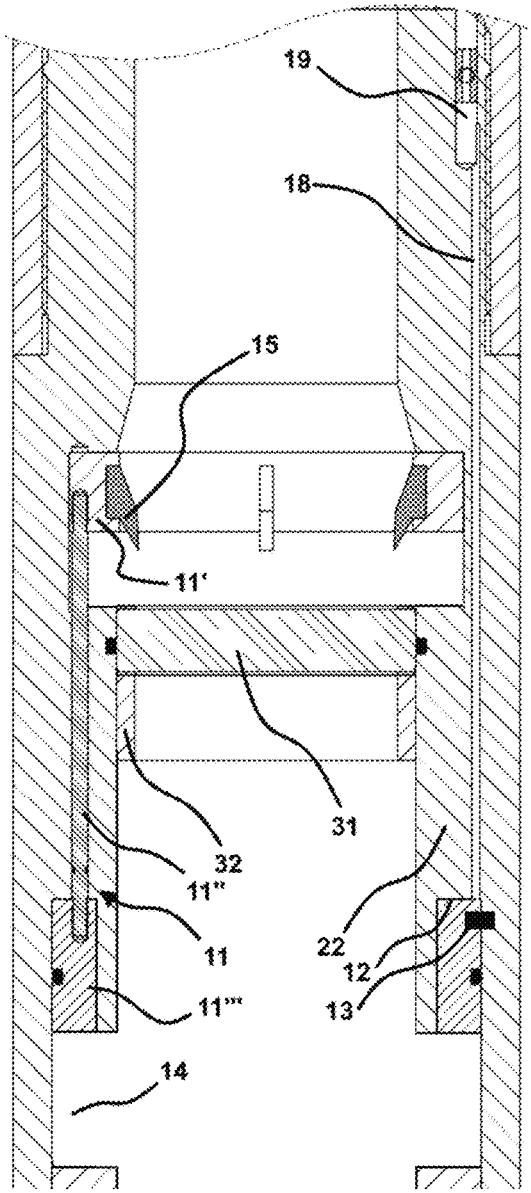

Reference is made to FIGS. 6A and 6B. FIG. 6A and FIG. 6B disclose a cross-sectional side view of another example of a plug breaker system 100. These two examples, the breaker object 15 is at a distance above the plugs 31. Specifically, mounted in or a part of the breaker body 11. The breaker body 11 is comprised of three parts 11',11",11'". The upper body part 11' contains the breaker object 15. The middle body part 11" links the upper body part 11' to the lower body part 11'". It is possible for the breaker body 11 to be comprised of only two pieces (e.g. the upper body part 11' is fixedly attached to the middle body part 11"). A portion of the breaker body 11 is arranged in the downstream tubular portion 22. The plug 31 is resting on the seat 32. In this example, the seat 32 is attached directly to the downstream tubular portion 22.

As described under FIGS. 5A-5C, at a certain uphole pressure in the well, the channel block 19 is moved into an open position. This allows the fluid pressure to enter the channel 18 and apply pressure (force) to the pressure catcher 12. Due to absolute or differential pressure across the shear element (shear pin is shown), the shear element breaks. As in the examples that use a shear element, a mechanical release element could be used. After the release mechanism 13 releases, a portion of the breaker body 11 enters the breaker chamber 14, the breaker object 15 comes into the contact with the plug 31, and breaks the plug 31.

In FIG. 6A, the breaker chamber 14 is sealed. In this configuration, the pressure under the plug 31 (often called downhole pressure) has little to no effect on when the release mechanism 13 releases. In FIG. 6B, the breaker chamber 14 is not sealed and when the release mechanism 13 (for example a shear element) releases is related to the pressure difference between uphole and downhole pressure.

Figure 7:
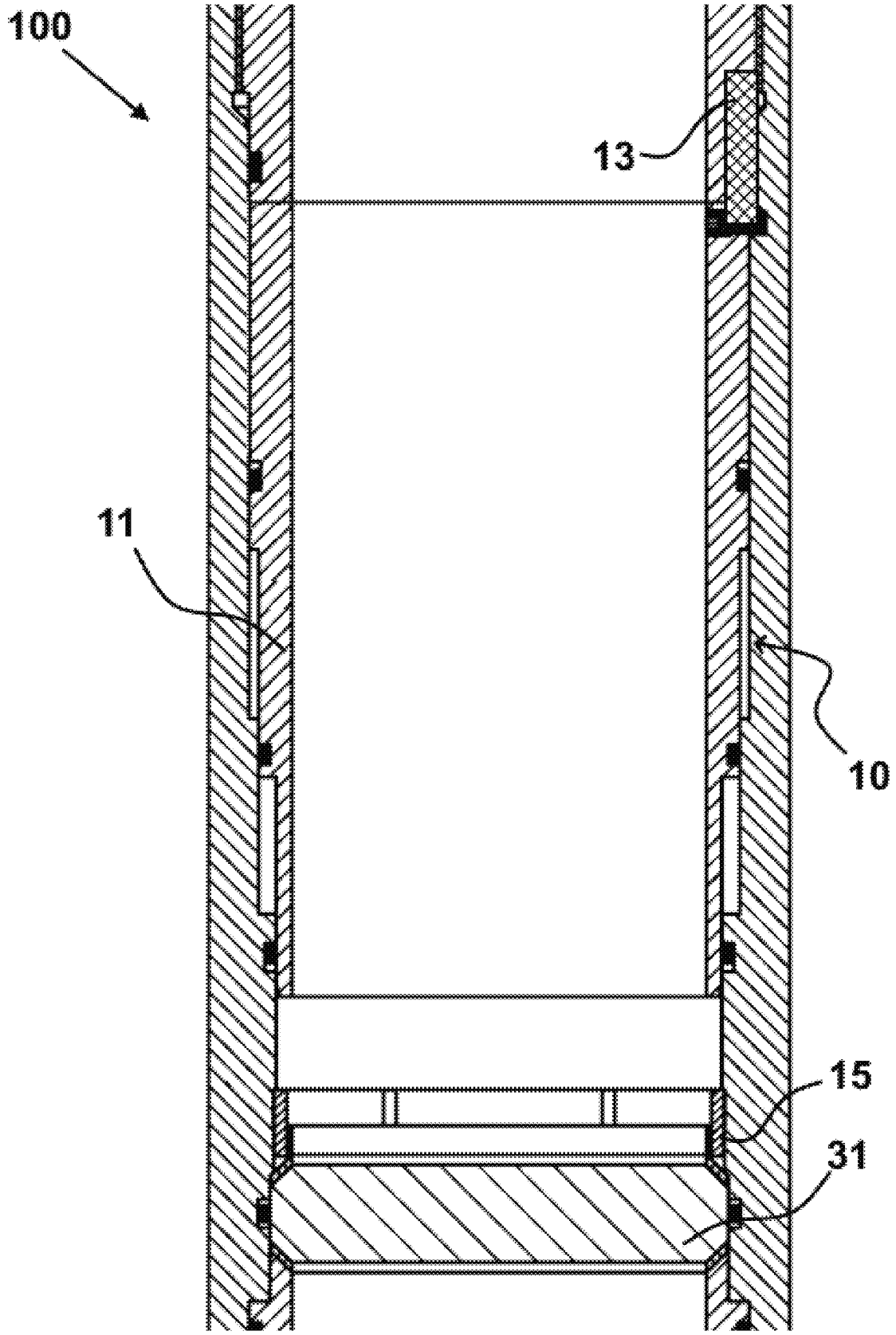

Reference is made to FIG. 7. FIG. 7 discloses a cross-sectional side view of another example of a plug breaker system 100, comprising a plug breaker with an explosive release mechanism 13. In this case, an breaker body 11 is held in place using a pin. This pin can be a shear pin, but usually it will be a non-shearable pin. The explosive will be close enough to the pin that the pin will break.

One advantage of using an explosive as the release mechanism 13 in a plug breaker 10 is that it requires a smaller explosion that would be expected to break the plug by explosion alone. The explosive release mechanism 13 can be triggered through acoustic triggering, RFID triggers, e-triggers, pressure pulses, or counters (not shown). A pin is not needed. The idea is that triggering the explosive release mechanism, causes the breaker body 11 to release and move from the first position to the second position.

Figure 8:
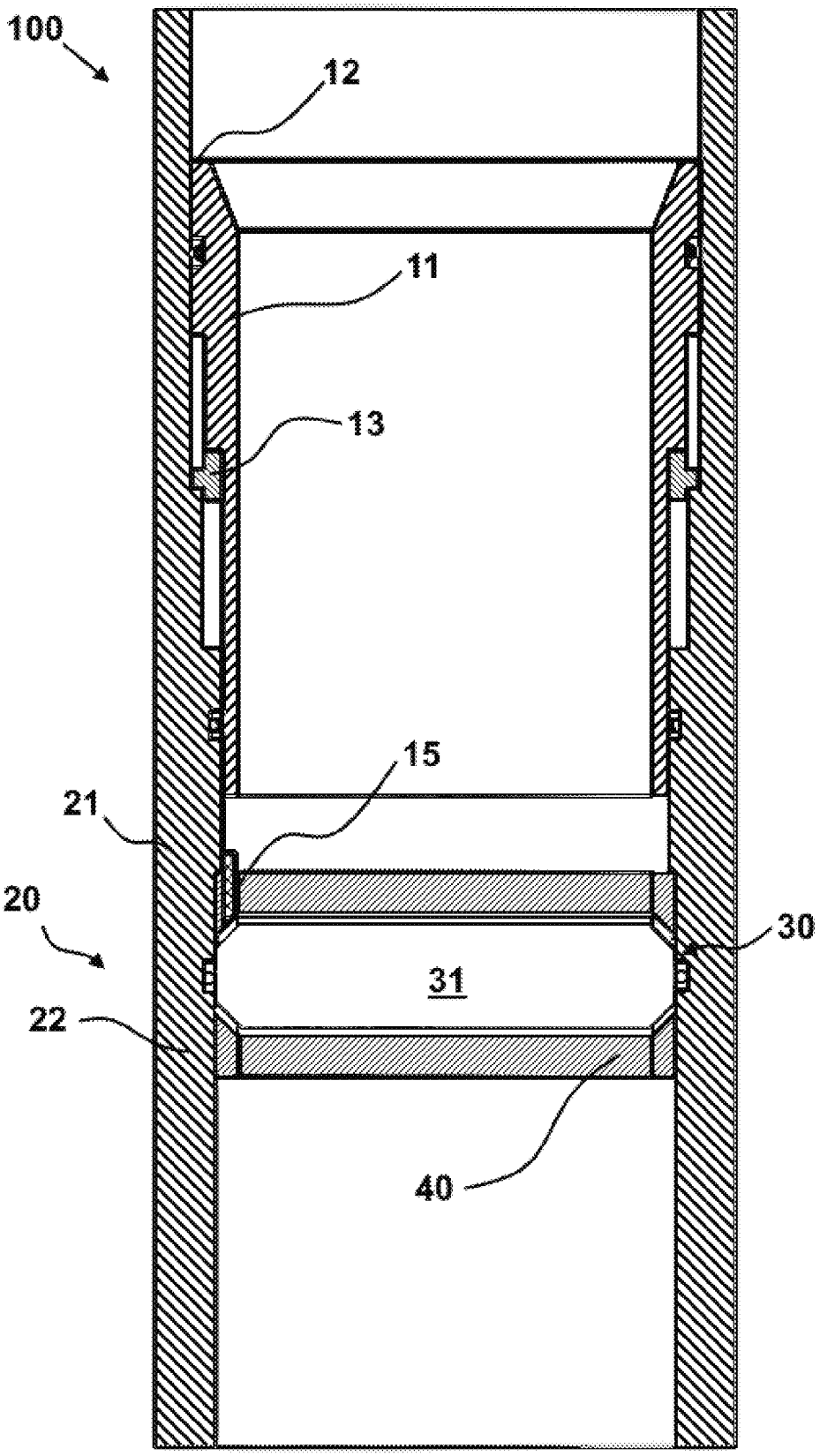
FIG. 8 discloses a cross-sectional side view of a plug assembly in a plug assembly holder.

Reference is made to FIG. 8. FIG. 8 discloses a cross-sectional side view of a plug breaker system 100 with plug assembly 30 in a plug assembly holder 40. The plug assembly 30 comprises a plug 31. The plug assembly 30 is arranged in a plug assembly holder 40. The plug assembly holder 40 is mounted to the housing 23. In this example, the plug assembly holder 40 is in the middle of the breaker tubular 20. As before the upstream tubular portion 21 of the breaker tubular 20 is upstream of the plug 31 and the downstream tubular portion 22 of the breaker tubular 20 is downstream of the plugs 31. The operation principles of the plug breaker system 100 is the same as previously. The pressure on the pressure catcher 12 (top portion of the breaker body 11) causes the release mechanism 13 to release and move downstream in an axial manner. The breaker body 11 drives the breaker object 15 into the plug 31.

Normally, the plug assembly holder 40 will not move in the second position. But it is conceivable that the plug assembly 30 or plug assembly holder 40 will move, but slower than separate breaker object 15.

That which is claimed is:

1. A plug breaker system (100) comprising:

a plug breaker (10) comprising a breaker body (11), a pressure catcher (12) arranged on the breaker body (11), a release element (13), a breaker object (15); and a plug assembly (30) comprising a plug (31), supported by a seat (32); and a breaker tubular (20) comprising an upstream tubular portion (21) and a downstream tubular portion (22), wherein the upstream tubular portion (21) is located upstream of the plug (31) and the downstream tubular portion (22) is located downstream of the plug (31);

wherein the plug assembly (30) and the plug breaker (10) are arranged in a housing (23) within the breaker tubular (20);

wherein the plug (31) is downstream from the breaker body (11);

wherein the breaker body (11) is separated by a distance from the breaker object (15), wherein the plug breaker system (100) is arranged to have a first position and a second position:

in the first position, the release element (13) is arranged such that the breaker body (11) is stationary and the plug assembly (30) is stationary with respect to the breaker tubular (20), and in the second position, the breaker body (11) is arranged such that when the release element (13) releases, the breaker body (11) moves downhole, and the breaker object (15) breaks the plug (31).

2. The plug breaker system (100) according to claim 1, wherein the plug (31) is stationary in the second position.

3. The plug breaker system (100) according to claim 1, wherein the pressure catcher (12) is arranged on an uphole and distal portion of the breaker body (11).

4. The plug breaker system (100) according to claim 1, wherein the release element (13) is arranged in a through hole in the breaker tubular (20).

5. The plug breaker system (100) according to claim 1, further comprising a sealed breaker chamber (14), wherein the sealed breaker chamber (14) is in contact with the release element (13), and wherein the release element (13) is a shear element.

6. The plug breaker system (100) according to claim 5, wherein the sealed breaker chamber (14) is arranged between the breaker body (11) and the housing (23).

7. The plug breaker system (100) according to claim 1, wherein the seat (32) is a portion of the breaker tubular.

8. The plug breaker system (100) according to claim 1, further comprising a holder (40), wherein the plug assembly (30) is arranged in the holder (40), and wherein the holder (40) is stationary in the first position with respect to the breaker tubular (20).

9. The plug breaker system (100) according to claim 1, wherein the breaker object (15) rests directly on the plug (31) in the first position.

10. The plug breaker system (100) according to claim 1, wherein the release element (13) is upstream of the plug (31).

11. The plug breaker system (100) according to claim 2, wherein the breaker body (11) and the breaker object (15) are a single element.

12. A plug breaker system (100) comprising:

a plug breaker (10) comprising a breaker body (11), a pressure catcher (12) arranged on the breaker body (11), a breaker object (15); and a plug assembly (30) comprising a plug (31), supported by a seat (32); and a breaker tubular (20) comprising an upstream tubular portion (21) and a downstream tubular portion (22), wherein the upstream tubular portion (21) is located upstream of the plug (31) and the downstream tubular portion (22) is located downstream of the plug (31);

a channel (18) and a channel block (19);

wherein the channel (18) is in fluid communication with the channel block (19);

wherein the plug assembly (30) and the plug breaker (10) are arranged in a housing (23) within the breaker tubular (20);

wherein the channel block (19) has an open position and closed position, and the channel block (19) is arranged such that:

there is no fluid communication through the channel block (19) and into channel (18) in the closed position, and there is fluid communication through the channel block (19) and into the channel (18) in the open position;

wherein the channel block (19) is arranged to move from the closed position to the open position when the release mechanism (13) releases, and wherein fluid in the channel (11) is arranged to move the breaker body (11) when the channel block (19) is in the open position.

13. The plug breaker system (100) according to the claim 12, where in the closed position, there is fluid communication between the uphole well pressure and the channel (18).

14. The plug breaker system (100) according to the claim 12, wherein the channel (18) is arranged in the breaker body (11).

15. The plug breaker system (100) according to claim 12, wherein the breaker body (11) is in contact with the channel (18).

16. The plug breaker system (100) according to claim 12, wherein the breaker body (11) is arranged entirely within the channel (18).

17. The plug breaker system (100) according to claim 12, wherein the plug (31) is stationary in the second position.

18. The plug breaker system (100) according to claim 12, wherein the seat (32) is a portion of the breaker tubular.

19. A plug breaker system (100) comprising:

a plug breaker (10) comprising a breaker body (11), a pressure catcher (12) arranged on the breaker body (11), a release element (13), a breaker object (15); and a plug assembly (30) comprising a plug (31), supported by a seat (32); and a breaker tubular (20) comprising an upstream tubular portion (21) and a downstream tubular portion (22), wherein the upstream tubular portion (21) is located upstream of the plug (31) and the downstream tubular portion (22) is located downstream of the plug (31);

wherein the breaker body (11) and breaker object (15) are separate unaffixed elements;

wherein the plug assembly (30) and the plug breaker (10) are arranged in a housing (23) within the breaker tubular (20);

wherein the plug (31) is downstream from the breaker body (11);

wherein the plug breaker system (100) is arranged to have a first position and a second position:

in the first position, the release element (13) is arranged such that the breaker body (11) is stationary and the plug assembly (30) is stationary with respect to the breaker tubular (20), and in the second position, the breaker body (11) is arranged such that when the release element (13) releases, the breaker body (11) moves downhole, and the breaker object (15) breaks the plug (31).

20. The plug breaker system (100) according to claim 19, wherein the breaker body (11) is not in contact with the breaker object (11) are not in contact in the first position.

* * * * *